US006147292A

United States Patent [19]

Ito

[11] Patent Number: 6,147,292

[45] Date of Patent: Nov. 14, 2000

[54] DATA-SETTING SYSTEM AND METHOD, AND RECORDING MEDIUM

[75] Inventor: Shinichi Ito, Hamamatsu, Japan

[73] Assignee: Yamaha Corporation, Hamamatsu, Japan

[21] Appl. No.: 09/511,610

[22] Filed: Feb. 23, 2000

[30] Foreign Application Priority Data

Mar. 1, 1999 [JP] Japan ..... 11-053215

[51] Int. Cl.[7] ..... G10H 1/18; G10H 7/00

[52] U.S. Cl. ..... 84/615; 84/653

[58] Field of Search ..... 84/600, 615, 653, 84/477 R

[56] References Cited

U.S. PATENT DOCUMENTS 5,300,723 4/1994 Ito ..... 84/615 X
5,723,803 3/1998 Kurakake .
5,728,961 3/1998 Tamura ..... 84/600
5,818,418 10/1998 Fujishita et al. ..... 84/600 X

*Primary Examiner*—Jeffrey Donels
*Attorney, Agent, or Firm*—Morrison & Foerster

[57] ABSTRACT

There are provided a data-setting system and method that permit easy operation even with one hand, and are capable of calling or selecting a desired one of functions for setting modes of generation of musical tones, which are associated with respective ones of a group of operating elements, or changing any of the functions to a desired one in a short time, and a recording medium storing a program for executing the method. A plurality of data-editing screens including a plurality of function-selecting screens for selecting the functions are switchably displayed on a display device for permitting editing of setting data. In response to an operation of one of the operating elements after operation of a direct access operating element, one of the data-editing screens which is associated with the operated operating element is directly displayed on the display device.

15 Claims, 12 Drawing Sheets

*FIG.5A*

VOICE EDIT
1.TIMBER
2.EG
3.FILTER
4.DSP←
⋮

*FIG.5B*

DSP EDIT
1.CONNECT
2.REVERB←
3.CHORUS
4.VARIATION
⋮

*FIG.5C*

REVERB EDIT
1.TYPE SELECT←
2.OUTPUT LEVEL
3.DEPTH
⋮

*FIG.5D*

REVERB SERECT
1.LARGE HALL←
2.SMALL HALL
3.ROOM
⋮

*FIG.12A*

22

SYSTEM EDIT
1.DIRECT ACCESS←
2.PROTECT SWITCH
3.MEMORY
4.MIDI SETTING
⋮

*FIG.12B*

22

DIRECT ACCESS ASSIGN
01.LAYER1 SELECT
02.LAYER2 SELECT
⋮
52.REVERB TYPE←
⋮

*FIG.12C*

22

DSP DIRECT ACCESS is
already assigned with
function 53.
Do you want to change ?

YES NO ←

*FIG.12D*

22

Function 52 is
assigned to DSP
module

DATA-SETTING SYSTEM AND METHOD, AND RECORDING MEDIUM

BACKGROUND OF THE INVENTION

1. Field of the Invention

The invention relates to a data-setting system that has operating elements associated with respective functions for setting modes of generation of musical tones, such as tone colors of musical tones, and effects selectively applied to musical tones, a data-setting method, and a recording medium storing a program for executing the method.

2. Prior Art

Conventionally, there has been proposed a data-setting system of this kind (first conventional data-setting system), in which, to change any one of functions for setting modes of generation of musical tones associated with respective operating elements, first, an edit operating element is operated, then edit screens displayed on a display device are switched sequentially from one to another by operating a cursor operating element, a paging operating element, a dial operating element, an enter key, and so forth, until a desired function screen displaying various functions is displayed, and a desired one of the functions is selected.

A second conventional data-setting system employs an assignable controller or an assignable switch which is capable of assigning a function for directly calling a predetermined tone color, or outputting a predetermined parameter value to one of operating elements.

A third conventional data-setting system employs a technique of assigning a function to a foot switch.

In a fourth conventional data-setting system, a predetermined function screen is displayed by continuously operating a predetermined operating element.

Further, in a fifth conventional data-setting system, a predetermined function screen is displayed by operating a predetermined operating element in combination with another operating element.

However, in the above first conventional data-setting system, it is required to operate operating elements, such as the cursor operating element, the paging operating element, the dial operating element, and the enter key, many times to display the desired function screen, and it is difficult to carry out such operation of the operating elements during musical performance. Therefore, this data-setting system is not suitable for operation during musical performance.

In the second conventional data-setting system, since a function itself is assigned directly to an operating element, no function screen or edit screen is displayed, and it is impossible to select a function from among a plurality of functions. To assign a plurality of functions to respective operating elements, as many assignable switches or controllers as the number of the functions have to be provided.

In the third conventional data-setting system, it is required to additionally provide a foot switch, and it is impossible to assign more than one function to the foot switch. A variation of this type of data-setting system permits assignment of a plurality of functions to a foot switch. In this variation, however, the functions are switched sequentially from one to another according to the number of times of stepping on the foot switch, so that it takes much time to reach a desired function. Therefore, it is difficult to carry out such operation of the foot switch during musical performance, thus being unsuitable for operation during musical performance.

In the fourth conventional data-setting system, it is required to hold the predetermined operating element or switch on until the predetermined function screen is displayed, and it takes much time to select a predetermined function. Therefore, the data-setting system is not suitable for operation during musical performance.

Further, in the fifth conventional data-setting system, it is required to operate two operating elements simultaneously. If the two operating elements are located remotely from each other, it is necessary to use both hands, which degrades operability of the data-setting system. Therefore, this data-setting system is not suitable for operation during musical performance, either.

SUMMARY OF THE INVENTION

It is an object of the present invention to provide a data-setting system and method that permit easy operation even with one hand, and are capable of calling or selecting a desired one of functions for setting modes of generation of musical tones, which are associated with respective ones of a group of operating elements, or changing any of the functions to a desired one in a short time, and a recording medium storing a program for executing the method.

To attain the above object, according to a first aspect of the invention, there is provided a data-setting system comprising an operation panel, a plurality of operating element groups arranged on the operation panel, the operating element groups each having at least one operating element associated respectively with functions for determining modes of generation of musical tones, a display device arranged on the operation panel, a screen display control section that switchably displays on the display device a plurality of data-editing screens for editing of setting data for permitting association of desired ones of the functions for determining modes of generation of musical tones with selected ones of the operating element groups and the at least one operating element, the data-editing screens including a plurality of function-selecting screens for selecting the functions for determining modes of generation of musical tones, a predetermined operating element other than the at least one operating element arranged on the operation panel, and a direct access control section responsive to an operation of one of the at least one operating element after operation of the predetermined operating element, for directly displaying on the display device one of the data-editing screens which is associated with the operated one of the at least one operating element.

According to the data-setting system of the present invention constructed as above, it is possible to directly display a function screen which is already assigned to an operating element or an operating element group or a data-edit screen close to the function-selecting screen simply by operating a predetermined operating element and then operating the first-mentioned operating element or any one of operating elements which belong to the operating element group. This makes it possible to display a desired one of the data-editing screens including function-selecting screens in a short time, without the need to carry out a number of operations. What is more, since it is only required to operate any one operating element, which belongs to an operating element group, an operation for displaying a desired data-editing screen can be effected easily even with one hand, and then, a function for determining a mode of generation of musical tones, which is associated with the operated operating element or the operating element group to which the operated operating element belongs, can be set or changed e.g. on a desired function-selecting screen. As a result, a desired function can be associated with a selected or operated operating element by a simple and quick operation, which makes it possible to meet the player's needs without hindering musical performance, thereby enabling him to broaden the range of expression by the performance.

It should be noted that the term "mode of generation of musical tones" used in the present specification means all musical tone elements, such as presence or absence of musical tone generation e.g. by a keyboard, button-type operating elements, etc., timing of tone generation (e.g. delayed sounding), manner of tone control through touch response, frequency (pitch) of musical tones, harmonic structure of musical tones (tone color in a narrow sense), envelope, amplitude of musical tones, such as volume, and effects applied to musical tones, such as vibrato, chorus, and reverberation, as well as output levels of effects, and depths of effects. That is, the term "mode of generation of musical tones" has a broad meaning of all the manners and methods of musical tone generation (including nonapplication of the above-mentioned musical tone elements) that produce auditory effects upon musical tones generated.

Preferably, the one of the data-editing screens which is associated with the operated one of the at least one operating element is one of the function-selecting screens which is assigned to the operated one of the at least one operating element, for permitting direct access thereto.

Preferably, the one of the data-editing screens which is associated with the operated one of the at least one operating element is one of the function-selecting screens which is assigned to one of the operating element groups to which the operated one of the at least one operating element belongs, for permitting direct access thereto.

Preferably, the data-setting system includes a data-editing screen-assigning section that assigns a selected one of the data-editing screens to one of the at least one operating element, for permitting direct access thereto.

More preferably, as the one of the at least one operating element, an operating element related to the selected one of the data-editing screens is automatically selected.

More preferably, the one of the at least one operating element is selected by selecting one of options representative of the at least one operating element, on one of the data-editing screens.

More preferably, the selected one of the data-editing screens is selected by being actually displayed.

More preferably, the selected one of the data-editing screens is selected by selecting one of options respectively representative of the data-editing screens on one of the data-editing screens.

Preferably, the data-setting system includes a data-editing screen-assigning section that assigns a selected one of the data-editing screens to one of the operating element groups, for permitting direct access thereto.

More preferably, as the one of the operating element groups, an operating element group related to the selected one of the data-editing screens is automatically selected.

More preferably, the one of the operating element groups is selected by selecting one of options representative of the operating element groups, on one of the data-editing screens.

More preferably, wherein the selected one of the data-editing screens is selected by being actually displayed.

More preferably, the selected one of the data-editing screens is selected by selecting one of options respectively representative of the data-editing screens on one of the data-editing screens.

To attain the above object, according to a second aspect of the invention, there is provided a data-setting method for a machine including an operation panel, a plurality of operating element groups arranged on the operation panel, the operating element groups each having at least one operating element, a display device arranged on the operation panel, and a predetermined operating element other than the at least one operating element arranged on the operation panel, the data-setting method comprising the steps of associating at least one operating element respectively with functions for determining modes of generation of musical tones, switchably displaying on the display device a plurality of data-editing screens for editing of setting data for permitting association of desired ones of the functions for determining modes of generation of musical tones with selected ones of the operating element groups and the at least one operating element, the data-editing screens including a plurality of function-selecting screens for selecting the functions for determining modes of generation of musical tones, and directly displaying on the display device one of the data-editing screens which is associated with the operated one of the at least one operating element in response to an operation of one of the at least one operating element after operation of the predetermined operating element.

To attain the above object, according to a third aspect of the invention, there is provided a recording medium storing a program for causing a machine including an operation panel, a plurality of operating element groups arranged on the operation panel, the operating element groups each having at least one operating element, a display device arranged on the operation panel, and a predetermined operating element other than the at least one operating element arranged on the operation panel, to perform a method of setting data, the method comprising the steps of associating at least one operating element respectively with functions for determining modes of generation of musical tones, switchably displaying on the display device a plurality of data-editing screens for editing of setting data for permitting association of desired ones of the functions for determining modes of generation of musical tones with selected ones of the operating element groups and the at least one operating element, the data-editing screens including a plurality of function-selecting screens for selecting the functions for determining modes of generation of musical tones, and directly displaying on the display device one of the data-editing screens which is associated with the operated one of the at least one operating element in response to an operation of one of the at least one operating element after operation of the predetermined operating element.

The above and other objects, features, and advantages of the invention will become more apparent from the following detailed description taken in conjunction with the accompanying drawings.

BRIEF DESCRIPTION OF THE DRAWINGS

FIGS. 5A to 5D show respective screens displayed on a display device during execution of the voice edit program routine;

FIGS. 12A to 12D show respective screens displayed on the display device during execution of the second variation of the assignment screen-setting program routine.

DETAILED DESCRIPTION

The present invention will now be described in detail with reference to the drawings showing an embodiment thereof.

Figure 1:
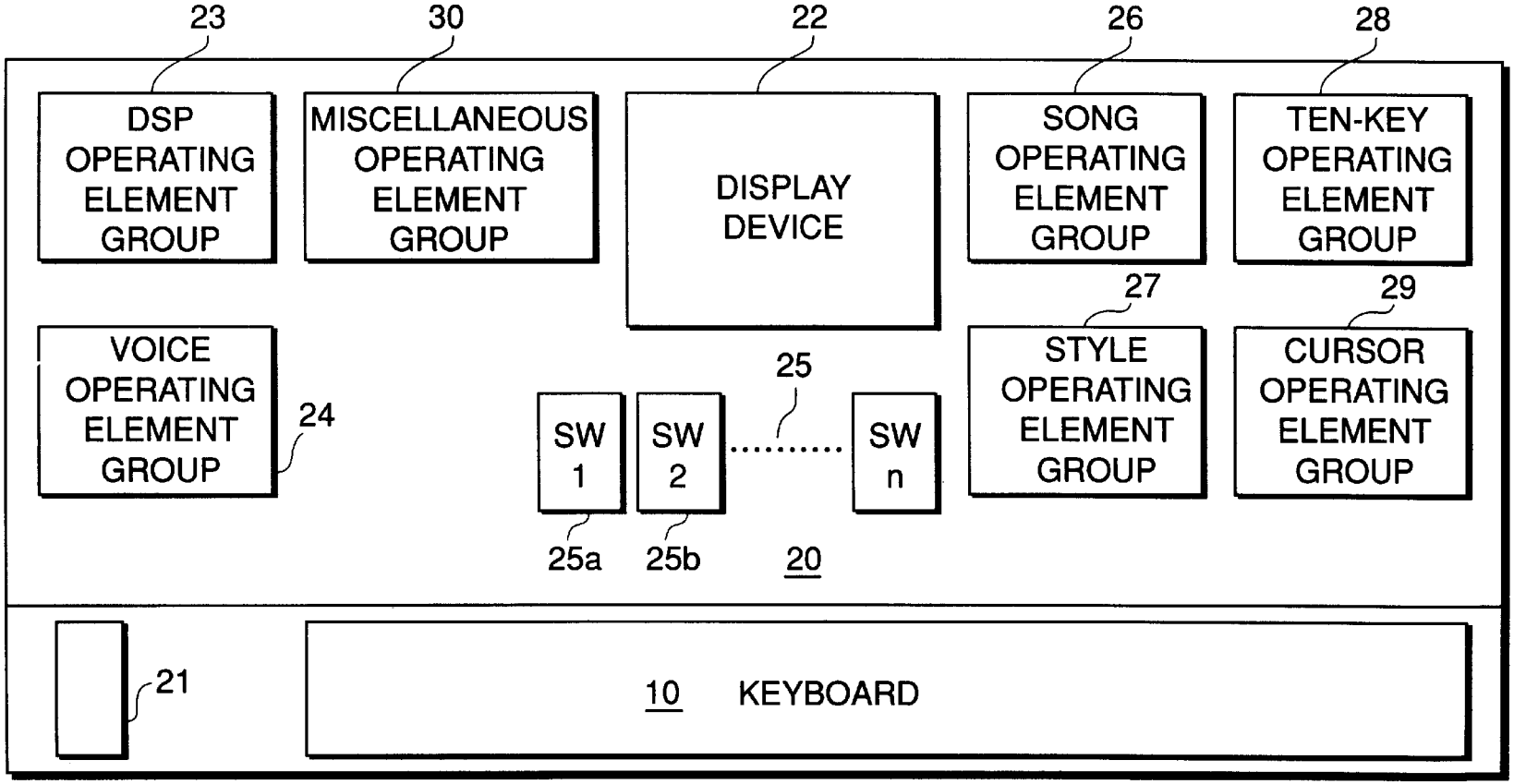
FIG. 1 is a plan view schematically showing the appearance of an electronic musical instrument incorporating a data-setthing system according to an embodiment of the invention.
Figure 2:
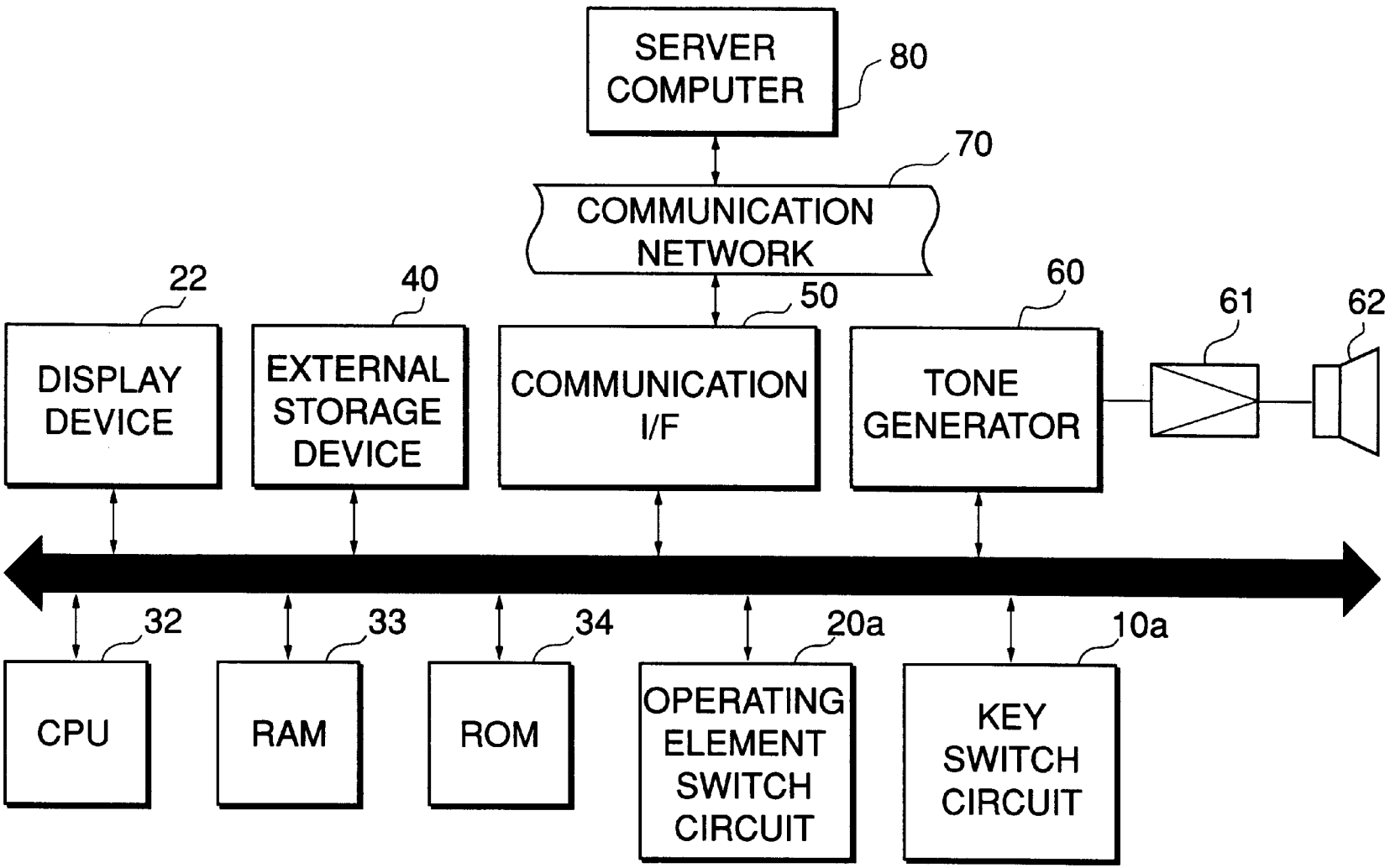
FIG. 2 is a block diagram showing the entire construction of an electric circuit system of the FIG. 1 electronic musical instrument.

FIG. 1 schematically shows, in plan view, the appearance of an electronic musical instrument to which a data-setting system according to an embodiment of the invention is applied, in plan view, while FIG. 2 shows the entire construction of an electric circuit system of the electronic musical instrument.

The electronic musical instrument includes a keyboard 10 and an operation panel 20. The keyboard 10 is comprised of a plurality of keys serving as a plurality of performance operating elements which each designate a specific tone pitch as well as give an instruction for generation of a musical tone signal indicative of the designated tone pitch. Depression or release of each key of the keyboard 10 is detected by a corresponding one of key switches arranged in a key switch circuit 10*a* and associated with the respective keys. Arranged on the operation panel 20 are a wheel 21 serving as a performance operating element for controlling effects or the like to be imparted to generated musical tone signals, and a display device 22 formed of a liquid-crystal display for displaying characters, etc. thereon, as well as a DSP operating element group 23, a voice operating element group 24, a program control operating element group 25, a song operating element group 26, a style operating element group 27, a ten-key operating element group 28, a cursor operating element group 29, and a miscellaneous operating element group 30. Operations of the operating element 21 and operating elements of the operating element groups 23 to 30 are detected by operating element switches arranged in an operating element switch circuit 20*a* and associated with the respective operating elements.

Figure 3A:
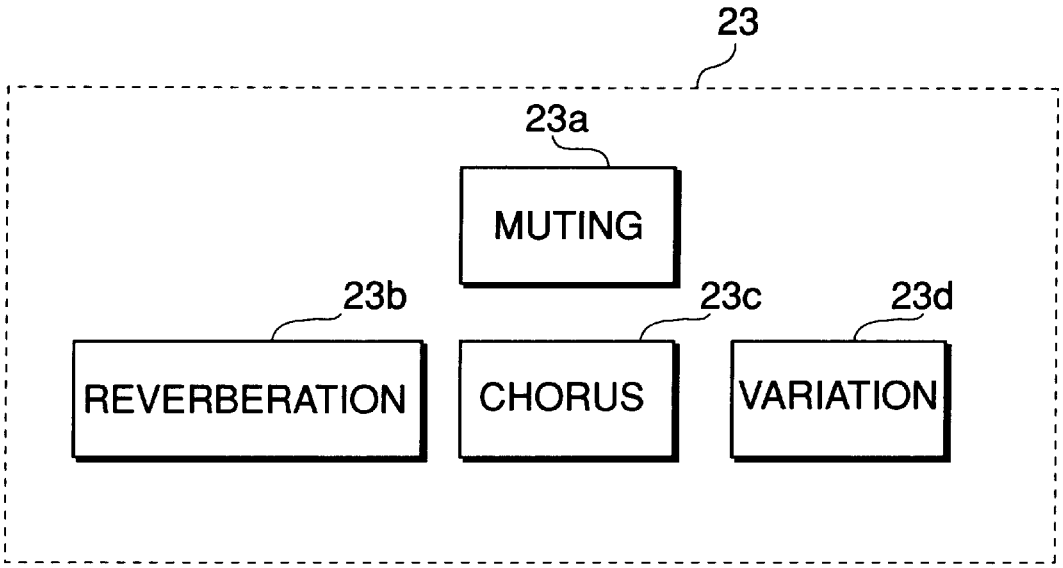
FIG. 3A is an enlarged plan view showing details of a DSP operating element group appearing in FIG. 1.

As shown in detail and on an enlarged scale in FIG. 3A, the DSP operating element group 23 is comprised of a muting operating element 23*a*, a reverberation operating element 23*b*, a chorus operating element 23*c*, and a variation operating element 23*d*. The muting operating element 23*a* alternately applies and stops applying a muting effect to a musical tone signal whenever it is depressed. The reverberation operating element 23*b* alternately applies and stops applying a reverberation effect to a musical tone signal whenever it is depressed. Similarly, the chorus operating element 23*c* alternately applies and stops applying a chorus effect to a musical tone signal whenever it is depressed, while the variation operating element 23*d* alternately applies and stops applying a variation effect to a musical tone signal whenever it is depressed.

Figure 3B:
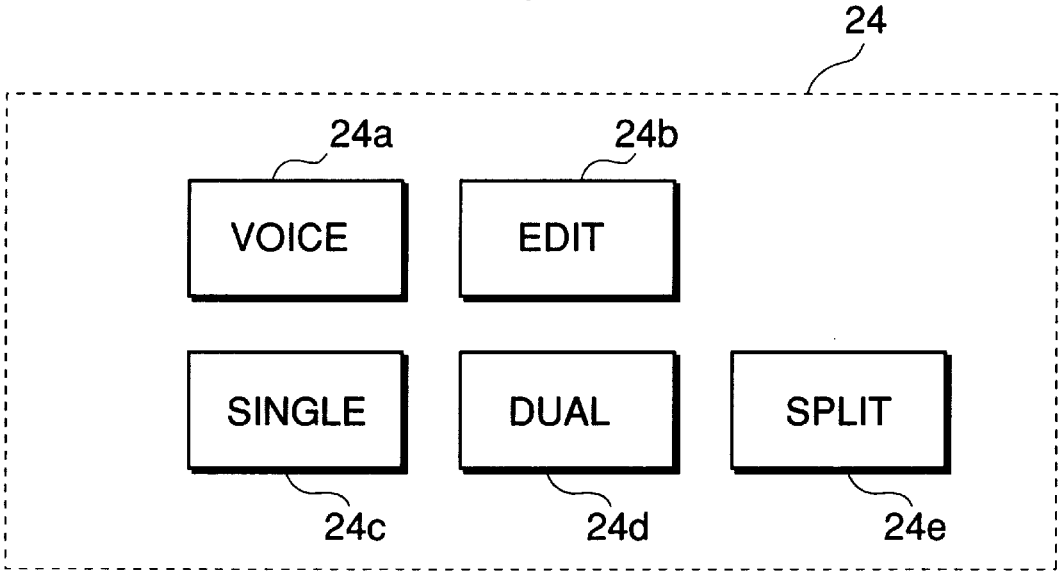
FIG. 3B is an enlarged plan view showing details of a voice operating element group appearing in FIG. 1.

As shown in FIG. 3B, the voice operating element group 24 is comprised of a voice operating element 24*a*, an edit operating element 24*b*, a single operating element 24*c*, a dual operating element 24*d*, and a split operating element 24*e*. The voice operating element 24*a* is operated to change tone color. After the operation of the voice operating element 24*a*, the tone color is changed by operating any of operating elements of the ten-key operating element group 28 and the cursor operating element group 29, and a slider operating element and a dial operating element, neither of which is shown, etc. The edit operating element 24*b* is operated to set the electronic musical instrument to a mode for editing parameters of a tone color currently selected or a mode for assigning a function to a selected one of the operating elements of the operating element groups 23, 24, 26, and 27 or a selected one of these groups. The single operating element 24*c* is operated to cause only musical tone signals belonging to layer 1 to be generated in response to depression of any key in the whole key range, while the dual operating element 24*d* is operated to cause musical tone signals belonging to layers 1 and 2 to be generated in a mixed manner in response to depression of any key in the whole key range. The split operating element 24*e* is operated to cause only musical tone signals belonging to layer 1 to be generated in response to depression of any key in a lower-pitch key range than a split point on the keyboard 10 and only musical tone signals belonging to layer 2 to be generated in response to depression of any key in a higher-pitch key range than the split point. It should be noted that the term "layer" generally means synthesizing a musical tone signal having a variety of tone colors by superposing (or mixing) a plurality of musical tone signals. However, the layers 1 and 2 in the present embodiment are used to synthesize musical tone signals having tone colors (timbres) in a broader sense including envelope.

The program control operating element group 25 includes at least a direct access operating element 25*a* and a system operating element 25*b*, each element being operated to start various programs or input commands during execution of the programs. The song operating element group 26 is operated to select a piece of music to be automatically played, while the style operating element group 27 is operated to select a type of rhythm, such as waltz, march, etc. to be employed in an automatic rhythm mode or an automatic accompaniment mode. The ten-key operating element group 28 includes a ten key pad, an enter key, a shift key, etc. for inputting various data in cooperation with a screen displayed on the display device 22. The cursor operating element group 29 is comprised of a plurality of cursor operating elements for moving a cursor on the screen of the display device 22 in leftward, rightward, upward and downward directions. The miscellaneous operating element group 30 is comprised of a plurality of operating elements for performing respective other functions than those described above.

The key switch circuit 10*a*, the display device 22, and the operating element switch circuit 20*a* are each connected to a bus 31. Further connected to the bus 31 are a CPU 32, a RAM 33, and a ROM 34, which form a main part of a microcomputer, as well as an external storage device 40, a communication interface 50, and a tone generator 60.

The CPU 32 executes programs for detecting operations of the keyboard 10 and the operation panel 20 made by the player, controlling readout of data from the RAM 33, the ROM 34, and a storage medium provided in the external storage device 40 and writing of data into the storage medium, and controlling generation of musical tone signals. The RAM 33 and the ROM 34 store the programs and various data.

The external storage device 40 includes a recording medium, such as a compact disk (CD), a flexible disk (FD), a hard disk (HDD), a magneto-optical disk (MO), a CD-ROM, a CR-R, a magnetic tape, a nonvolatile memory card, a removable hard disk (ZIP), or a so-called smart medium, for use in recording various data and programs, and a drive device for reading the various data and programs from the recording medium and writing the data and programs into the same. The communication interface 50 includes a MIDI (Musical Instrument Digital Interface) for enabling connection of the electronic musical instrument to an external unit, such as another electronic musical instrument, and a computer, and thereby permitting inputting and outputting of performance data for controlling generation of musical tones, tone colors of the generated musical tones, etc. and other programs and data.

The communication interface 50 is connected to the communication network 70 which may be LAN (Local Area Network), the Internet, or a telephone line, so as to be connected to a server computer 80 via the communication network 70. In the case where a certain program or a certain set of parameters is not stored in the hard disk (HDD), the communication interface 50 may be used for downloading the program or the parameters from the server computer 80. The electronic musical instrument sends a command to the server computer 80 via the communication network 70, to request downloading of the program or set of parameters. Upon receipt of the command, the server computer 80 delivers the requested program or set of parameters to the electronic musical instrument, through the communication network 70 and the communication interface 50. The electronic musical instrument stores them in the hard disk. In this manner, downloading is accomplished.

It is also possible to provide another interface for transmitting and receiving data directly to and from an external computer or the like.

The tone generator 60 includes a musical tone signal-forming circuit for forming musical tone signals according to the player's operation of the keyboard 10, and an effect-imparting circuit for imparting effects to the musical tone signals. The tone generator 60 forms musical tone signals based on performance data supplied via the bus 31, and selectively imparts effects to the musical tone signals according to operation of operating elements of the DSP operating element group 23, to output the resulting signals. A loudspeaker 62 is connected to the tone generator 60 via an amplifier 61.

Next, the operation of the electronic musical instrument constructed as above will be described.

After turning on a power switch, not shown, a player selects a tone color, effects, and so forth by operating operating elements of the voice operating element group 24, the DSP operating element group 23, etc. and starts playing the electronic musical instrument by operating the keyboard 10 and the wheel 21. As the player plays the electronic musical instrument, the electronic musical instrument operates as follows: The CPU 32 executes a program, not shown, to thereby detect operations by the player, and then delivers performance data for designating the tone color of musical tones to be generated, effects to be applied to the musical tones, etc., performance data for controlling generation of the musical tones, and so forth, to the tone generator 60 via the bus 31. The tone generator 60 forms a musical tone signal having the tone color, effects, etc. based on the performance data input thereto, according to the operations of the keyboard 10 and the wheel 21 by the player, and delivers the musical tone signal via the amplifier 61 to the speaker 62 for generation of musical tones.

Next, description will be made of a setting operation for associating a desired one of functions (for setting respective modes of generation of musical tones) with a selected one of the operating elements of the DSP operating element group 23, the voice operating element group 24, the song operating element group 26, the style operating element group 27, etc., by referring to an example of associating a function of setting a reverberation effect "LARGE HALL" as one of reverberation effects with the reverberation operating element **23*b* of the DSP operating element group 23, i.e. a case of designating, out of a plurality of effects set for each tone color, the reverberation effect "LARGE HALL" as an effect to be selected by the reverberation operating element 23*b***.

Figure 4:
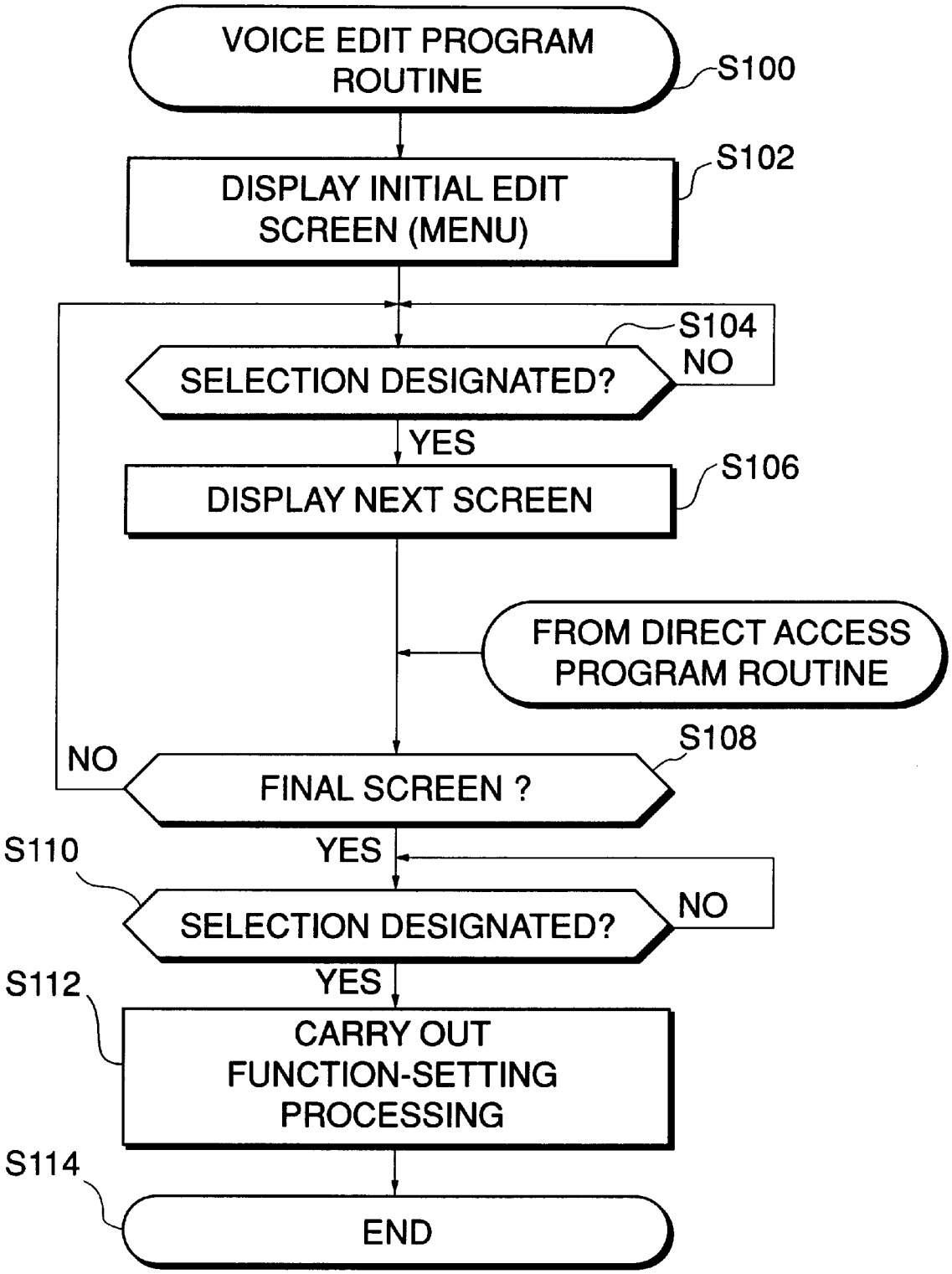
FIG. 4 is a flowchart showing a voice edit program routine which is executed by a CPU appearing in FIG. 2.

First, a tone color is designated by operating the voice operating element **24*a*, operating elements of the ten-key operating element group 28 and the cursor operating element group 29, the slider operating element, the dial operating element group, etc. Then, the edit operating element 24*b* is operated, and then the CPU 32 starts execution of a voice edit program routine shown in FIG. 4 at a step S100. At a step S102, a display screen of the display device 22 is switched to an initial edit screen, i.e. a menu screen (see FIG. 5A), and at a step S104, a selection for designation on the initial edit screen is awaited. This selection, and other selections, referred to hereinafter, are performed by operating operating elements of the cursor operating element group 29 to move the cursor to a character string, a mark, or the like on a screen displayed for selection, and then depressing the enter key. An arrow "←" appearing on each of the display screen shown in FIG. 5**A and other display screens, described hereinafter, indicates a position of the cursor.

In the illustrated case, an option "4. DSP" is selected on the FIG. 5A initial edit screen. As a result of this operation, the answer to the question of the step S104 becomes affirmative (Yes), so that the program proceeds to a step S106, wherein the display screen of the display device 22 is switched to a next screen. Then, it is determined at a step S108 whether or not the present screen displayed at the step S106 is a final screen (function screen). If the answer is negative (No), i.e. if the screen is not the final screen, the program returns to the step S104, whereas if the answer is affirmative (Yes), i.e. if the screen is the final screen, the program proceeds to a step S110. In this case, since the screen displayed on the display device 22 is not a final screen (function screen) but an edit screen (selection screen) shown in FIG. 5B, the answer to the question of the step S108 is negative (No), so that the program returns to the step S104, wherein a selection for designation is awaited again.

In the illustrated case, an option "2. REVERB" is selected on the edit screen shown in FIG. 5B, so that the answer to the question of the step S104 becomes affirmative (Yes), and the display screen is switched to an edit screen shown in FIG. 5C at the step S106. Accordingly, the answer to the question of the step S108 is negative (No), so that the program returns to the step S104, wherein a selection for designation is awaited again. In the illustrated case, an option "1. TYPE SELECT" is selected on the FIG. 5C edit screen, so that the answer to the question of the step S104 becomes affirmative (Yes), and at the step S106, the display screen is switched to a screen shown in FIG. 5D. At this time, the resulting display screen is a function screen i.e. final screen, so that the answer to the question of the step S108 becomes affirmative (Yes), and the program proceeds to the step S110, wherein a selection for designation is awaited. If an option is selected, i.e. if the answer to the question of the step S110 becomes affirmative (Yes), function-setting processing is executed at a step S112, followed by terminating the voice edit program at a step S114. In the present example, the option "LARGE HALL" is selected on the FIG. 5D screen, whereby this option is associated with the reverberation operating element 23*b*, as a type of reverberation effect to be set by operating the operating element.

Next, description will be made of direct access processing directly related to the present invention, which is carried out when any one of operating elements of one or a plurality of ones of the operating element groups including the DSP operating element group 23, the voice operating element group 24, the song operating element group 26, the style operating element group 27, etc. is operated, for directly switching the display screen of the display device 22 to a function screen or an edit screen assigned to the operated one operating element or the one operating element group or the plurality of operating element groups. In the following, it is assumed that the reverberation operating element 23*b* of the DSP operating element group 23 is operated.

Figure 6:
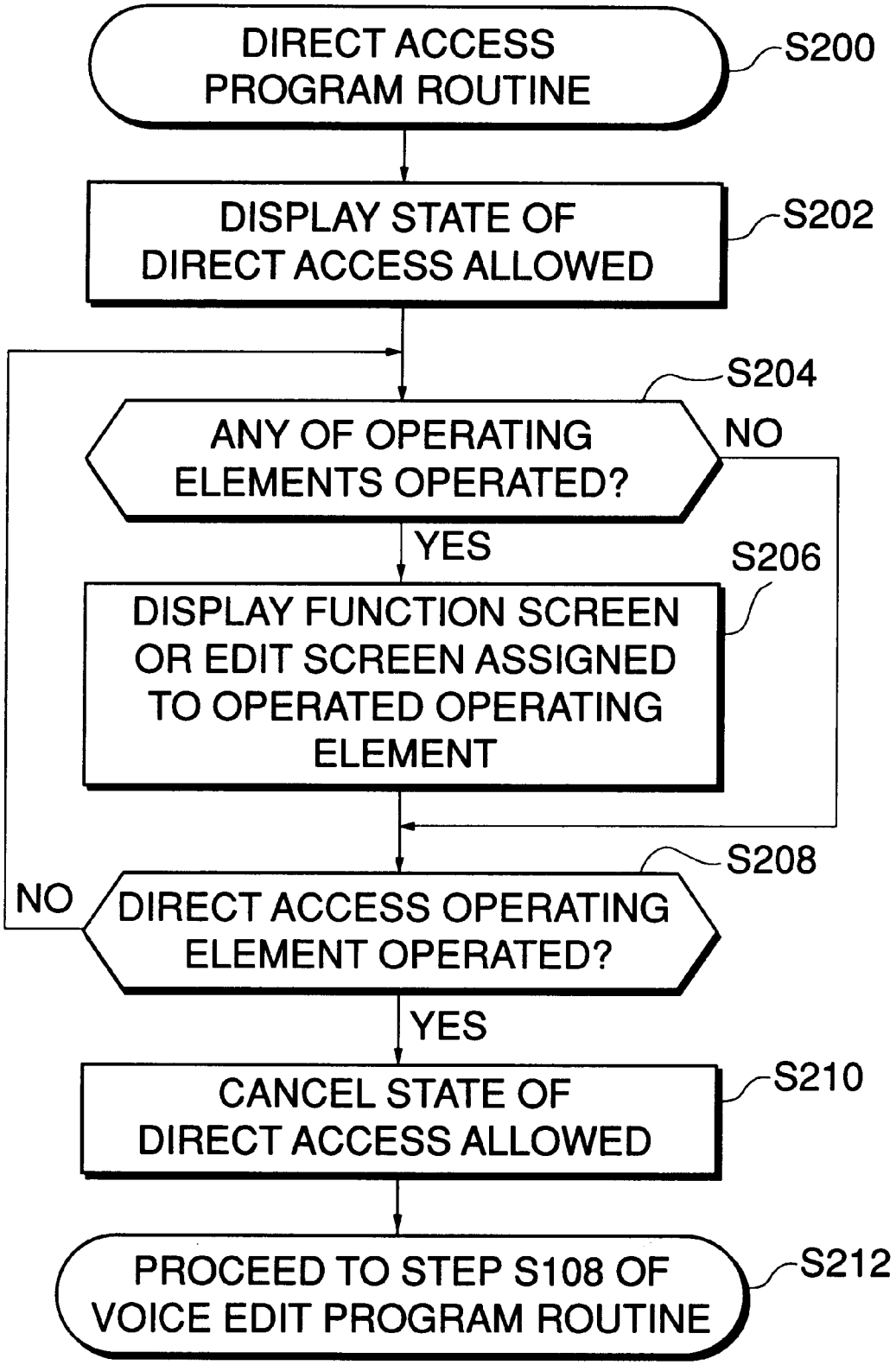
FIG. 6 is a flowchart showing a direct access program routine which is executed by the CPU.

First, the player operates the direct access operating element 25*a*. In response to this operation, the CPU 32 starts execution of a direct access program routine shown in FIG. 6 at a step S200, and then at a step S202, an indication that the electronic musical instrument is in a direct access mode is displayed on the display device 22, or an indication lamp incorporated in the direct access operating element 25*a* is lit. Then, it is determined at a step S204 whether or not any one of the operating elements of a predetermined one or a predetermined plurality of operating element groups (including the DSP operating element group in the present example) has been operated. If no such operating element has been operated, i.e. if the answer to the question of the step S204 is negative (No), the program proceeds to a step S208, wherein it is determined whether or not the direct access operating element 25*a* has been operated again. If the direct access operating element 25*a* has not been operated again, i.e. if the answer to the question of the step S208 is negative (No), the program proceeds to the step S204, followed by repeatedly carrying out the steps S204 and S208 so long as the answers to these questions are negative (NO).

On the other hand, if any one of the operating elements (the reverberation operating element 23*b* of the DSP operating element group 23 in the present example) has been operated, i.e. if the answer to the question of the step S204 becomes affirmative (Yes), the program proceeds to a step S206, wherein the display screen of the display device 22 is switched to an edit screen or a function screen assigned to the operated operating element (the reverberation operating element 23*b*). Data indicative of each edit screen or function screen assigned to each predetermined operating element is stored in the ROM 34. Therefore, at the step S204, data indicative of the edit or function screen assigned to the operated operating element group is read out from the ROM 34, and then the display screen of the display device 22 is switched to the edit or function screen based on the data. In this example, the directly displayed screen is the reverberation selection screen (REVERB SELECT) in FIG. 5D, i.e. a function screen, or the FIG. 5C reverberation edit screen (REVERB EDIT), i.e. an edit screen close to the function screen (REVERB SELECT). When the direct access operating element 25*a* is operated, the answer to the question of the step S208 becomes affirmative (Yes), so that the program proceeds to a step S210, wherein the direct access mode is canceled. In the cancellation, the indication lamp is turned off if it is then on. Then, the program proceeds to the step S108 of the voice edit program via a step S212.

Thus, if the directly displayed screen is the reverberation selection screen (function or final screen) shown in FIG. 5D, it is possible to associate the reverberation operating element 23*b* of the DSP operating element group 23 with any one of "1. LARGE HALL", "2. SMALL HALL", "3. ROOM", etc. as an effect to be set when this operating element is operated, by only one selecting operation in accordance with the steps S108 to S112. On the other hand, if the directly displayed screen is the reverberation edit screen (edit screen), it is possible to effect the same association by only two selecting operations in accordance with the steps S104 to S112.

Thus, according to the above embodiment, simply by operating a selected one of the operating elements of operating element groups including the DSP operating element group 23, the voice operating element group 24, the song operating element group 26, the style operating element group 27, etc. after operating the direct access operating element 25*a*, it is possible to switch the display screen of the display device 22 directly to a function screen or an edit screen close to the function screen, which is assigned to the operated operating element. This dispenses with the need of carrying out a number of operations to display a desired function screen in a short time. What is more, since the player has only to operate a selected one of a plurality of operating elements for this purpose, this operation for displaying the desired function screen can be carried out easily even with one hand. Then, the function associated with the operated operating element for setting a mode of generation of musical tones can be changed on the displayed function screen. As a result, a desired function can be associated with a selected operating element by a simple and swift operation, which can meet the player's needs without hindering musical performance thereby permitting him to broaden the range of expression by the performance.

Although in the above example, the final screen is a screen for selecting a type of the reverberation, this is not limitative, but it may be a screen for setting an output level of the effect of the reverberation (screen to be displayed by selecting "2. OUTPUT LEVEL" in FIG. 5C), or a depth of the same effect (screen to be displayed by selecting "3. DEPTH" in FIG. 5C), and it may be configured that this screen can be directly displayed by the direct access processing, through its association with the reverberation operating element 23*b*.

Further, it is preferred that characters or the like are displayed on the display device 22 in a larger size at the step S206 than in normal cases because the display of a screen at the step S206 is more often carried out during musical performance. Although in the above example, it is configured that after operating the direct access operating element 25*a*, by operating any one of the predetermined operating elements, a function screen or an edit screen assigned to the operated operating element is directly displayed, this is not limitative, but it may be configured that by operating any of the predetermined operating elements and another predetermined operating element in combination, a function screen or an edit screen is directly displayed. Further, in place of assigning a function screen or an edit screen to an operating element and thereby permitting a function for determining a mode of generation of musical tones, which is associated with the operating element, to be called by the direct access processing through operation of the operating element, as described above, a function screen or an edit screen is assigned to an operating element group and thereby permitting a function for determining a mode of generation of musical tones, which is associated with the operating element group, to be called by the direct access processing through operation of any operating element of the operating element group. For instance, to apply the direct access processing to the voice operating element group 24, a tone color-changing screen (function screen), not shown, is assigned to all the operating elements of the voice operating element group 24, whereby when any of these operating elements is operated, the display screen is directly switched to the tone color-changing screen to thereby permitting a tone color of layer 1 or layer 2 to be changed.

Figure 7:
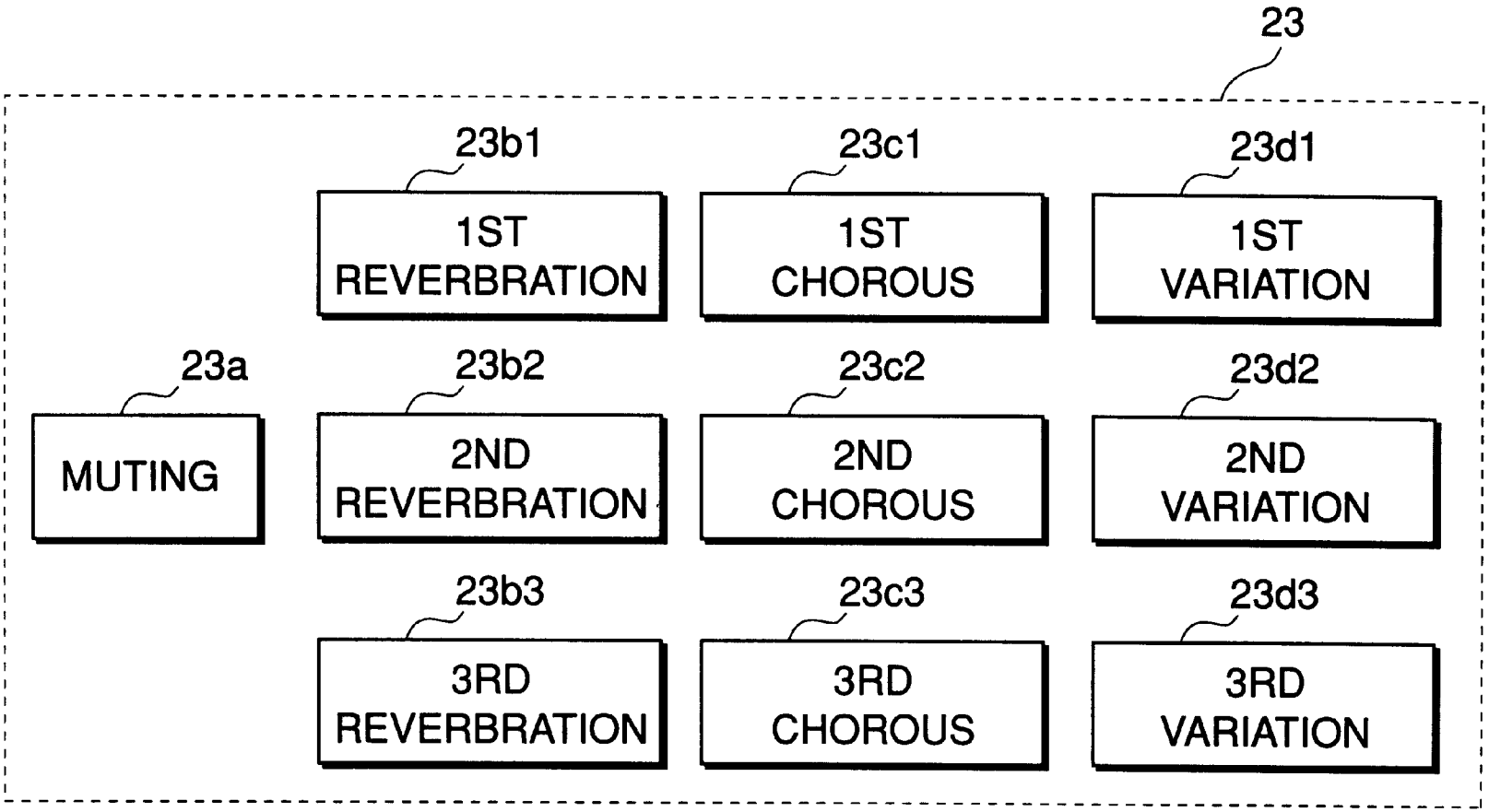
FIG. 7 is a plan view showing a variation of the DSP operating element group.

Further, the display screen of the display device 22 may be directly switched to a function screen or an edit screen assigned to any one of sub operating element groups formed by dividing each of the operating element groups including the DSP operating element group 23, the voice operating element group 24, the song operating element group 26, the style operating element group 27, etc., into a plurality of smaller groups, whereby when any one of operating elements of the sub operating element groups is operated. For example, as shown in FIG. 7, first to third reverberation operating elements 23*b*1 to 23*b*3, first to third chorus operating elements 23*c*1 to 23*c*3, and first to third variation operating elements 23*d*1 to 23*d*3 are provided in the DSP operating element group 23 to form respective sub operating element groups. These operating elements 23*b*1 to 23*b*3, 23*c*1 to 23*c*3, and 23*d*1 to 23*d*3 are provided in advance for enabling selection from three kinds of reverberation effects, three kinds of chorus effects, and three kinds of variation effects.

In this case, when at least any one of the reverberation operating elements 23*b*1 to 23*b*3 is operated during execution of the direct access program after operation of the direct access operating element 25*a*, the display screen is switched directly to a function screen or an edit screen assigned in advance to the operating elements 23*b*1 to 23*b*3. When any one of the chorus operating elements 23*c*1 to 23*c*3 is operated after operation of the direct access operating element 25*a*, the display screen is directly switched to a function screen or an edit screen assigned in advance to the operating elements 23*c*1 to 23*c*3. Similarly, when any one of the variation operating elements 23*d*1 to 23*d*3 is operated, the display screen is directly switched to a function screen or an edit screen assigned in advance to the operating elements 23*d*1 to 23*d*3.

Further, main effect data for designating selection from a plurality of reverberation types, from a plurality of chorus types, and from a plurality of variation types may be provided for each tone color as a parameter for use in DSP editing, so as to enable direct display of a function screen for selecting from the reverberation types, the chorus types, or the variation types, according to the main effect data that is selected for each tone color. More specifically, when any operating element of the DSP operating element group 23 is operated after operating the direct access operating element 25*a*, the display screen of the display device 22 is switched to a corresponding function screen for selection from the reverberation types, the chorus types, or the variation types, which is displayed based on main effect data that correspond to a tone color of a musical tone being currently sounded. The corresponding function screen for the selection is e.g. the screen shown in FIG. 5D. Further, the main effect data can also be modified in various manners by processing the same based on other programs.

Further, although in the above embodiment, data indicative of edit screens or function screens to be directly displayed by the direct access processing, i.e. screens assigned to the respective operating elements of the operating element groups 23, 24, 26, and 27 is stored in the ROM 34 in advance for each tone color, and hence it is impossible to change the assigned screens, this is not limitative, but the data may be stored in the external storage device 40 to allow these screens to be changed. In this case, the data may be read out from the storage device 40 and once stored in the RAM 33 during execution of the step S202 to permit the same to be utilized during execution of the step S206, and then deleted from the RAM 33 during execution of the step S210. Alternatively, the data may be written in the RAM 33 before starting a musical performance.

Next, a method of configuring (setting and changing) the data indicative of each of the screens assigned to the respective operating elements will be described.

Figure 8:
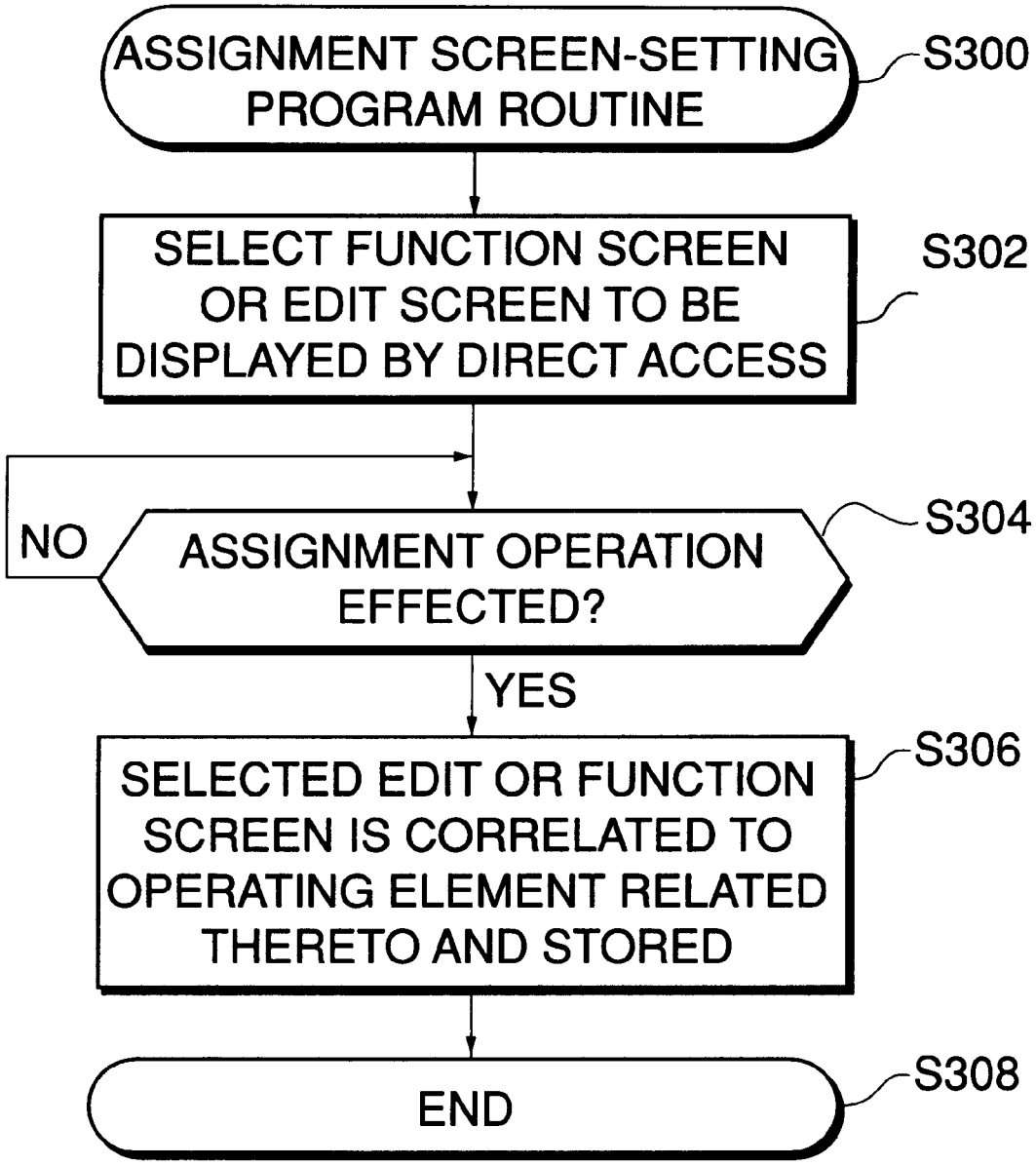
FIG. 8 is a flowchart showing an assignment screen-setting program routine which is executed by the CPU.

First, the player executes an assignment screen-setting program routine shown in FIG. 8 by operating the system operating element 25*b*. The assignment screen-setting program is started at a step S300, and an edit screen or a function screen to be displayed during execution of the direct access processing is selected at a step S302. This screen selection may be carried out by executing processing similar to that of the steps S102 to S108 of the FIG. 4 voice edit program routine. After the execution of the processing, it is determined at a step S304 whether or not an assignment operation has been effected. The assignment operation is effected by operating the direct access operating element 25*a* while simultaneously operating a predetermined operating element (e.g. the shift key provided in the ten-key operating element 28). So long as the assignment operation has not been effected, i.e. the answer to the question of the step S304 is negative (No), the step S304 is repeatedly executed. On the other hand, if the assignment operation has been effected, i.e. if the answer to the question of the step S304 is affirmative (Yes), the program proceeds to a step S306.

At the step S306, data indicative of the selected edit or function screen is correlated to an operating element related to the edit or function screen, and stored as assignment data associated with the tone color currently selected. For example, if the FIG. 5C reverberation edit screen (edit screen) or the FIG. 5D reverberation selection screen (function screen) is displayed on the display device 22, assignment data which is not only correlated to the operating element related to the reverberation effects, i.e. the reverberation operating elements 23*a* for selecting and controlling the reverberation effects but also correlated to the tone color currently selected is set to a value indicative of the reverberation edit screen or the reverberation selection screen and stored in any one of the storage media within the external storage device 40 and the RAM 33. The data is preserved even when the power of the electronic musical instrument is off. The assignment screen-setting program is terminated at a step S308.

Thus, the edit screens or the function screens assigned to the respective various operating element groups in a manner correlated to each tone color can be changed variously, which enables configuration of the direct access according to the player's preference.

It is preferable that after the configuration of the assignment data, the assignment data, an operating element (e.g. the reverberation operating element 23*b* in the above example) correlated to the assignment data and/or a tone color i.e. the currently selected tone color is/are indicated on the display device 22. This enables the player to easily grasp the correspondence between the selected edit or function screen, the operating element, and the tone color.

It should be noted that each function screen or edit screen may be also configured to be assigned to a related operating element group, instead of an operating element as in the above described embodiment, such that operation of any operating element of the operating element group causes direct displaying of the function screen or edit screen.

Next, description will be made of a first variation of the method of configuring the data indicative of the assignment screens.

Figure 9:
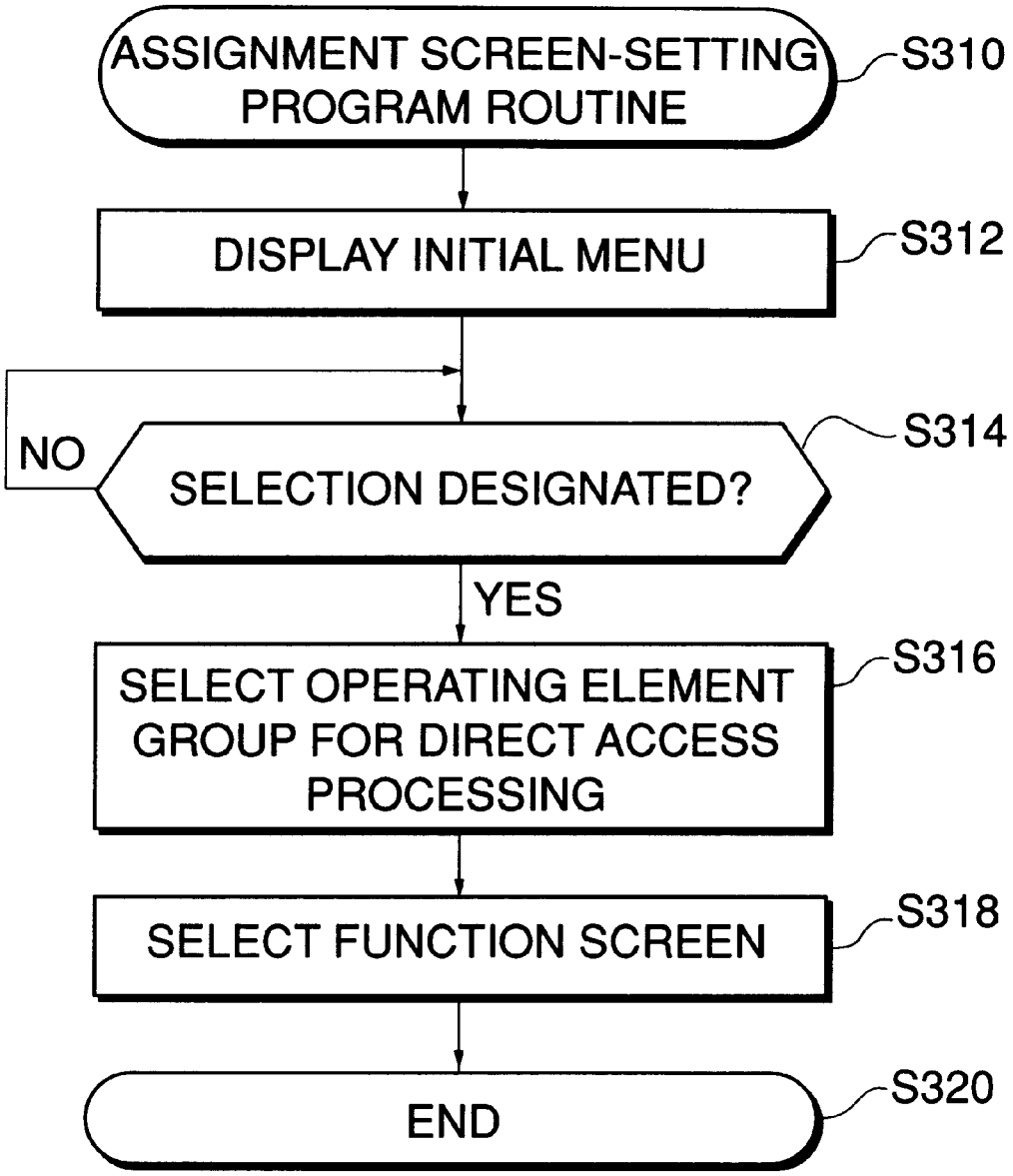
FIG. 9 is a flowchart showing a first variation of the assignment screen-setting program routine.

Also in the first variation, first, the player also operates the system operating element 25*b* to thereby execute an assignment screen-setting program routine shown in FIG. 9. The program routine is started at a step S310, and at a step S312, the display screen of the display device 22 is switched to an initial menu screen (see FIG. 10A), on which a selection for designation is awaited. The selection for designation is also carried out by operating operating elements of the cursor operating element group 29 to move the cursor to a character string, a mark, or the like to be selected on the display screen and then operating the enter key.

Figure 10A:
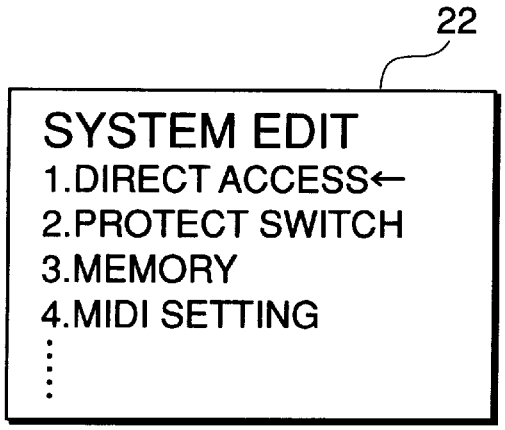
FIGS. 10A to 10C show respective screens displayed on the display device during execution of the first variation of the assignment screen-setting program routine.

In the illustrated example of FIG. 10A, an option "1. DIRECT ACCESS" is selected. As a result of the selection, it is judged at step S314 that the selection for designation has been carried out, so that the program proceeds to a step S316, wherein processing for selecting an operating element group to which the direct access processing is to be applied is carried out. In the processing for selecting the operating element group, the kinds of the operating element groups (1. VOICE, 2. SONG, 3. STYLE, 4. DSP) are displayed on the display device 22, and the cursor operating element group 26 is operated to move the cursor to a character string representing the kind of a desired operating element group, and then the operating element group is designated e.g. by operating the enter key in the tenkey operating element group 28. When the selection of the operating element group is completed, the program proceeds to a step S318, wherein processing for selecting a function screen to be assigned to the selected operating element group is carried out. In the processing for selecting a function screen, similarly to the above operation for selecting an operating element group, menu options indicative of respective candidates for the function screen to be assigned to the selected operating element group are displayed on the display device 22, and a desired one is selected from the menu options on the display screen by operating operating elements of the cursor operating element group 29, the enter key, etc.

Figure 10B:
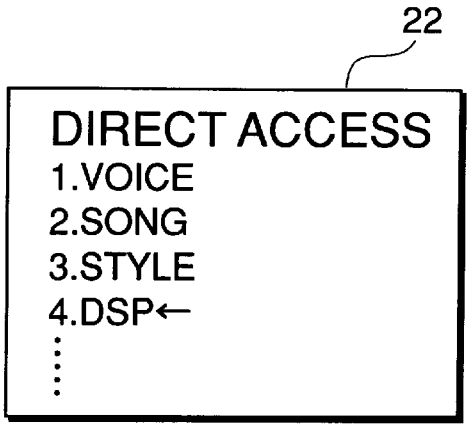
Figure 10C:
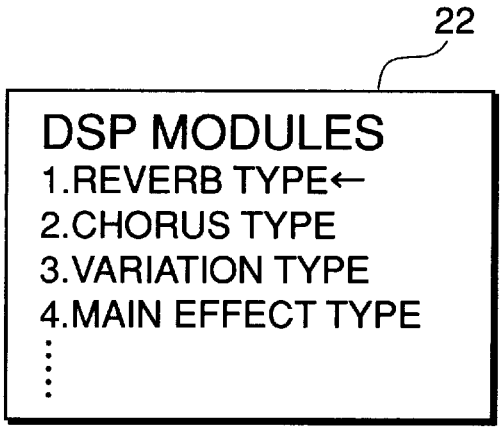

The following description refers to a case where a reverberation selection screen (REVERB TYPE) is assigned to the DSP operating element group 23. At the step S316, a character string "4. DSP" indicative of the DSP operating element group 23 is designated on the display screen shown in FIG. 10B. Accordingly, at the step S318, the display screen of the display device 22 is switched to a screen shown in FIG. 10C, and a character string "1. REVERB TYPE" indicative of a selection screen for selection of a reverberation type is selected by operating the enter key. Then, the assignment screen-setting program is terminated at a step S320. This makes it possible to assign a desired function screen to a selected operating element group in a manner correlated to each tone color.

If, in the above procedure of the first variation, first at the step S316, an operating element is selected, and then at the step S318, a desired function screen is selected, the desired function screen can be assigned to the selected operating element.

Next, description will be made of a second variation of the method of configuring the data indicative of the assignment screens.

Figure 11:
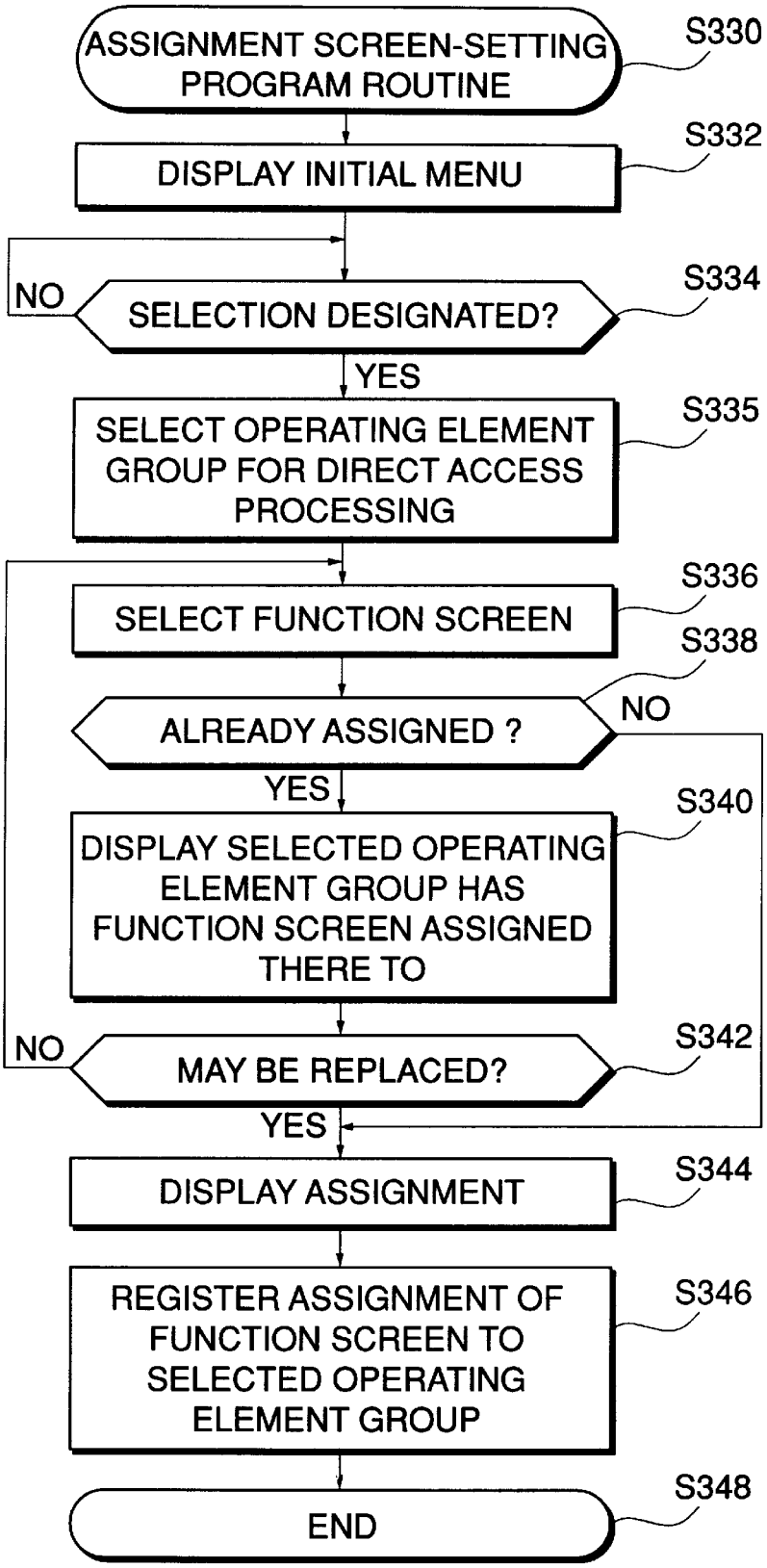
FIG. 11 is a flowchart showing a second variation of the assignment screen-setting program routine.

In the second variation, first, the player executes an assignment screen-setting program shown in FIG. 11 by operating the system operating element 25*b*. The program is started at a step S330, and steps S332, S334 and S335 are sequentially executed similarly to the steps S312, S314 and S316 of the first variation. More specifically, when the direct access processing is selected from a menu shown in FIG. 12A and designated, the answer to the question of the step S334 becomes affirmative (YES), and the program proceeds to the step S335, wherein an operating element group for the direct access processing is selected. Then, at a step S336, a function screen to be displayed directly by the direct access processing is selected.

In the processing for selecting the function screen, the kinds of all function screens (1. LAYER1 SELECT, 2. LAYER2 SELECT, . . . 52. REVERB TYPE, . . .) are displayed on the display device 22, and then an operating element or elements of the cursor operating element group 29 are operated to move the cursor to a character string indicative of the kind of a desired function screen on the display screen, and the desired function screen is selected e.g. by operating the enter key of the numeric keypad operating element group 28. In this case, since the display device 22 has a limited display area, the display screen of the display device 22 is scrolled with movement of the cursor.

Then, when the desired function screen is selected by the processing at the step S336, the program proceeds to a step S338, wherein it is determined whether or not there is a function screen already assigned to the selected operating element group, based on assignment registration data, referred to hereinafter. If there is a function screen already assigned to the selected operating element group, i.e. if the answer to the question of the step S338 is affirmative (Yes), the display screen of the display device 22 is switched to a screen shown in FIG. 12C at a step S340, and then, it is determined at a step S342 whether or not the player wants to replace the function screen which is already assigned to the operating element group with the newly selected function screen. If an option "YES" indicating "I want to replace the assigned function screen with the newly selected function screen" is designated by operating the display device 22, the cursor operating element group 29, and the enter key, so that the answer to the question of the step S342 becomes affirmative (Yes), the program proceeds to a step S344, wherein the display screen of the display device 22 is switched to a screen showing the new assignment (see FIG. 12D). Then, at a step S346, the function screen selected at the step S336 is registered in place of the existing registered function screen. More specifically, existing assignment registration data indicative of the existing registered function screen is deleted from a storage medium in the external storage device 40 and the RAM 33, and new assignment registration data indicative of the selected function screen is stored in the storage medium and the RAM 33. The assignment registration data is preserved even after the power of the electronic musical instrument is turned off. Then, the assignment screen-setting program is terminated at a step S348.

Even if the answer to the question of the step S338 is negative (No), i.e. if no assignment of a function screen to the selected operating element group selected at the step S335 is registered yet, the function screen selected at the step S336 is registered by the processing at the steps S344 and S346, as well. In this case, correspondence between a function screen and an operating element group is set based on each operating element group, and hence it is possible to recognize which function screen the selected operating element group is assigned to. For example, when the screen (function 52) for selecting a type of reverberation effect is selected as shown in FIG. 12B, another function screen (function 53) is recognized to have been assigned to the DSP operating element group 23, which is selected, as shown in FIG. 12C.

On the other hand, if an option "NO" indicating "I do not want to change the function screen currently assigned to the operating element group" is selected at the step S342, the answer to the question of the step S342 becomes negative (No), and the program returns to the step S336, wherein a new function screen is selected.

Thus, the above second variation also makes it possible to variously change the function screens assigned to the respective operating element groups in a manner correlated to each tone color.

Further, in the first and second variations, it is also possible to assign edit screens to respective operating element groups. In this case, it is only required to display menu options indicative of the kinds of various edit screens at the step S318 of the first variation and at the step S346 of the second variation, respectively, and then select one indicative of a desired edit screen out of the displayed kinds of edit screens.

It is to be understood that the object of the present invention may also be accomplished by supplying the electronic musical instrument with a storage medium in which a software program code that realizes the functions of the illustrated embodiment is recorded, and causing the CPU 32 of the instrument to read out and execute the program code stored in the storage medium.

In this case, the program code itself read from the storage medium accomplished the novel functions of the present invention, and thus the storage medium storing the program code constitutes the present invention.

The storage medium for supplying the above mentioned program code to the system or apparatus may be selected from the floppy disc (FD), the hard disk (HDD), the optical disk, the magneto-optic disk (MO), the CD-ROM, the CD-R, a magnetic tape, a nonvolatile memory card, the removable hard disk ZIP, and the smart media. The program code may also be supplied from the other MIDI equipment, or the server computer 80 via the commutation network 70.

What is claimed is:

1. A data-setting system comprising:

an operation panel;

a plurality of operating element groups arranged on said operation panel, said operating element groups each having at least one operating element associated respectively with functions for determining modes of generation of musical tones;

a display device arranged on said operation panel;

a screen display control section that switchably displays on said display device a plurality of data-editing screens for editing of setting data for permitting association of desired ones of said functions for determining modes of generation of musical tones with selected ones of said operating element groups and said at least one operating element, said data-editing screens including a plurality of function-selecting screens for selecting said functions for determining modes of generation of musical tones;

a predetermined operating element other than said at least one operating element arranged on said operation panel; and a direct access control section responsive to an operation of one of said at least one operating element after operation of said predetermined operating element, for directly displaying on said display device one of said data-editing screens which is associated with the operated one of said at least one operating element.

2. A data-setting system according to claim 1, wherein said one of said data-editing screens which is associated with the operated one of said at least one operating element is one of said function-selecting screens which is assigned to the operated one of said at least one operating element, for permitting direct access thereto.

3. A data-setting system according to claim 1, wherein said one of said data-editing screens which is associated with the operated one of said at least one operating element is one of said function-selecting screens which is assigned to one of said operating element groups to which the operated one of said at least one operating element belongs, for permitting direct access thereto.

4. A data-setting system according to claim 1, including a data-editing screen-assigning section that assigns a selected one of said data-editing screens to one of said at least one operating element, for permitting direct access thereto.

5. A data-setting system according to claim 4, wherein as the one of said at least one operating element, an operating element related to said selected one of said data-editing screens is automatically selected.

6. A data-setting system according to claim 4, wherein the one of said at least one operating element is selected by selecting one of options representative of said at least one operating element, on one of said data-editing screens.

7. A data-setting system according to claim 4, wherein said selected one of said data-editing screens is selected by being actually displayed.

8. A data-setting system according to claim 4, wherein said selected one of said data-editing screens is selected by selecting one of options respectively representative of said data-editing screens on one of said data-editing screens.

9. A data-setting system according to claim 1, including a data-editing screen-assigning section that assigns a selected one of said data-editing screens to one of said operating element groups, for permitting direct access thereto.

10. A data-setting system according to claim 9, wherein as the one of said operating element groups, an operating element group related to said selected one of said data-editing screens is automatically selected.

11. A data-setting system according to claim 9, wherein the one of said operating element groups is selected by selecting one of options representative of said operating element groups, on one of said data-editing screens.

12. A data-setting system according to claim 9, wherein said selected one of said data-editing screens is selected by being actually displayed.

13. A data-setting system according to claim 9, wherein said selected one of said data-editing screens is selected by selecting one of options respectively representative of said data-editing screens on one of said data-editing screens.

14. A data-setting method for a machine including an operation panel, a plurality of operating element groups arranged on said operation panel, said operating element groups each having at least one operating element, a display device arranged on said operation panel, and a predetermined operating element other than said at least one operating element arranged on said operation panel, the data-setting method comprising the steps of:

associating at least one operating element respectively with functions for determining modes of generation of musical tones;

switchably displaying on said display device a plurality of data-editing screens for editing of setting data for permitting association of desired ones of said functions for determining modes of generation of musical tones with selected ones of said operating element groups and said at least one operating element, said data-editing screens including a plurality of function-selecting screens for selecting said functions for determining modes of generation of musical tones; and directly displaying on said display device, one of said data-editing screens which is associated with the operated one of said at least one operating element in response to an operation of one of said at least one operating element after operation of said predetermined operating element.

15. A recording medium storing a program for causing a machine including an operation panel, a plurality of operating element groups arranged on said operation panel, said operating element groups each having at least one operating element, a display device arranged on said operation panel, and a predetermined operating element other than said at least one operating element arranged on said operation panel, to perform a method of setting data, the method comprising the steps of:

associating at least one operating element respectively with functions for determining modes of generation of musical tones;

switchably displaying on said display device, a plurality of data-editing screens for editing of setting data for permitting association of desired ones of said functions for determining modes of generation of musical tones with selected ones of said operating element groups and said at least one operating element, said data-editing screens including a plurality of function-selecting screens for selecting said functions for determining modes of generation of musical tones; and directly displaying on said display device one of said data-editing screens which is associated with the operated one of said at least one operating element in response to an operation of one of said at least one operating element after operation of said predetermined operating element.

* * * * *